US005215483A

United States Patent [19]

Whitworth

[11] Patent Number: 5,215,483

[45] Date of Patent: Jun. 1, 1993

[54] HIGH SPEED SEA TRAIN

[76] Inventor: Arthur B. Whitworth, 215 S. 4th St., Winterset, Iowa 50273

[21] Appl. No.: 812,408

[22] Filed: Dec. 23, 1991

[51] Int. Cl.[5] ..... B63B 3/08

[52] U.S. Cl. ..... 440/38; 440/93; 114/102; 114/242

[58] Field of Search ..... 440/38, 93; 114/242, 114/248, 249, 250, 253, 145 A, 102

[56] References Cited

U.S. PATENT DOCUMENTS

| | | | |
|---|---|---|---|
| 1,069,996 | 8/1913 | Angelicola | 114/145 A |
| 1,259,860 | 3/1918 | Haussler | 114/250 |
| 3,125,981 | 3/1964 | Reynolds | 440/93 |
| 3,939,794 | 2/1976 | Hull | 440/38 |
| 4,452,163 | 6/1984 | Ayeva | 114/250 |

*Primary Examiner*—Jesus D. Sotelo
*Assistant Examiner*—Stephen P. Avila
*Attorney, Agent, or Firm*—Rod Bryant Jordan

[57] ABSTRACT

A vessel for pleasure or cargo transportation in which the vessel is born by a special flotation method comprising a plurality of circular floats that are designed to be rotated at high speed in such a way that the vessel skims across the water riding on the crests of the waves. The vessel is powered primarily by jet pumps in such a way that the vessels may be linked as a train, each successive jet pump taking advantage of the residual effect of the preceding jet pump. It is also powered by a vector sail system. A special laser alignment system is employed, for maintaining alignment, when the vessels are linked in a train.

18 Claims, 8 Drawing Sheets

HIGH SPEED SEA TRAIN

BACKGROUND OF THE INVENTION

The present invention relates to a vessel suitable for high speed travel across large bodies of water over a variety of wave conditions. The vessel is born by special flotation devices utilizing trapped air, and powered by a variety of efficient, practical power sources. The vessel could be operated as a single unit or as a train of linked units. When used as a train of linked units a special alignment system is employed.

DESCRIPTION OF THE PRIOR ART

Other vessels have been designed for high speed water travel such as the hydroplane. These vessels, though possessing speed, lacked the ability to be linked and therefore the capacity to transport large quantities of cargo. Other previously known vessels designed to carry large amounts of cargo are slow and cumbersome. The vessel as described herein will provide a fast, safe, and reliable, method of ocean transport with a huge cargo capacity.

SUMMARY OF THE INVENTION

The invention as described herein comprises a vessel having a unique method of flotation, propulsion, and steering. The vessel rides on a plurality of circular disks. These disks are rotated at high speed. They are rotated in opposite directions so that stability is maintained. The underside of each disk is equipped with three concentric, donut shaped pods. Between each pod there is a circular cavity. Air is trapped within these cavities, helping to buoy the vessel. The outer edge of the outermost pod is covered with golf ball like dimples. During rotation these dimples create a compressed air field at the surface of the pod. This also creates lift. The outer surface of the outermost pod is essentially flat and is tilted at 37 degrees from horizontal. This is the angle of maximum efficiency. These especially designed disks hover and skim across the crests of the waves rather than riding on the water surface by mere flotation. They thus support the vessel above the water much the same as a frizby supports itself in the air. This minimizes friction, does away with the age old problem of pushing through displaced water, and allows the vessel to traverse over rough seas at high speed.

The flotation disks are rotated at high speed, preferably by a single power source, through a system of drive shafts and gear boxes. The most efficient speed of rotation is 200 MPH at the outer rim of the disk. The disks may also be pivotally mounted so that they can be aligned more narrowly in order to allow for overland transporting. In order to increase buoyancy and light weight strength, each disk or spin float may be constructed of super strength woven steal or other suitable materials. Each spin float may also be constructed so as to have an inner cavity which can be filled with lighter than air gas. Air scoop blades may be affixed to the upper sides of the spin floats. These air scoop blades would pull air from around each spin float and direct it at high volume through a hole in the center of the upper surface of the spin float. This hole should be just smaller than the smallest of the concentric pods. The downward rush of air would be trapped within the center of the spin float, and would therefore exert pressure upon the surface of the water, thus increasing lift.

The vessel as described may be operated as a single unit, perhaps for recreational use, or may be linked together in a train of units. When used in the linked mode the vessel acquires a extremely large cargo capacity. Cargo may then be transported very swiftly and efficiently, due to the fact that each unit travels in the relatively calm wake of the preceding unit and utilizes the presence of the jet stream of water that is produced by the jet pump propulsion unit of each successive unit. It is the preferred design of this invention that it be used in the linked mode. This would produce a swift, efficient method for intercontinental transporting of large amounts of cargo, something that the world has long sought.

There is a jet pump located at the bow of each unit. This jet pump provides forward thrust and creates a jet stream of water which flows toward the rear of each unit. When used as a train in the linked mode each jet pump on each successive unit draws power from and adds to the jet stream. The sea train is therefore propelled forward in a very efficient manner. There is also a plurality of hydraulically driven centrifugal pumps attached to the bottom of each unit. These pumps are located to either side of the jet stream. They take in water and discharge it rearward and toward the jet stream at an angle of 37 Degrees. This again is the most efficient angle of dispersion. These pumps add to forward thrust and may be pivoted to provide steering and power during slow speed docking maneuvers.

Each unit is also propelled by a plurality of vector sails. Each vector sail consists of a cylindrically shaped, upright structure whose surface is covered with golf ball like dimples. The structure is spun at high speed. As the sail is spun, the dimples create a field of compressed air which creates forward thrust. Each sail is also equipped with a set of air scoop blades. These blades are affixed to the inner surface of the cylindrical sail. The upper rim of each sail is curved inward, graduating into a relatively flat inner rim. Air is directed into the interior of the sail through a hole, or center rim opening, which is one third the diameter of the sail itself. The essentially flat surface of the inner rim is tilted from level at an angle of 37 degrees. This precise tilt, along with the one third diameter opening, directs air into the interior of the sail in the most efficient possible manner. A set of air suction blades affixed to the cylinder wall inner surface directs a high volume of air down through the center of the sail. Each sail may be positioned directly above a hole in the deck of the vessel. This hole may be located above the hole in the center of a spin float so that the air pressure being directed down through the sails is added to the air pressure being sucked into the central cavity of the spin float by the blades affixed to the spin float itself. This creates additional lift as more air pressure is exerted on the surface of the water. A sail may also be positioned over a hole in the deck which is directly above the jet pump intake port. The rush of air would then be directed into the intake of the jet pump, thus increasing power and efficiency.

While being operated in the linked or sea train mode the vessel must rely upon a system of alignment in order to maintain efficiency and stability at high speed. The alignment of the sea train is maintained through the use of a laser emitter-detector system and an "water plow" rudder. Each unit is equipped with a laser emitter and an array of laser detectors. The laser detectors are located at the rear of each unit and consist of a plurality of laser sensors situated in a row across the unit in a line perpendicular to the length of each unit. The laser emitter of the forward unit directs a laser beam toward the row of laser detectors on the rearward unit. When aligned the laser beam will strike the center of the array. As the units become miss-aligned the direction and degree of miss-alignment is detected by the array of laser detectors as the laser beam cuts an ark across the horizontally positioned sensor arrangement. This information is processed and fed to the control unit of the "water plow" rudder. The rudder is equipped with a hydraulic arm for lowering it into the water and a hydraulic arm for setting the tilt of the rudder. The proper tilt of the rudder is set according to the miss-alignment detected. the rudder blade is then lowered into the jet stream of water where it will remain until the unit is properly aligned. The inverted plow rudder may also be lowered into the jet stream at zero angle as a means of decelerating the vessel.

DETAILED DESCRIPTION

Figure 1:
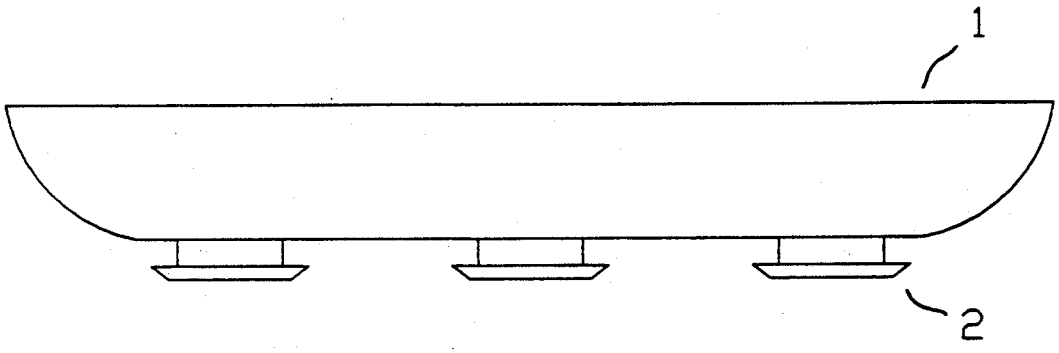
FIG. 1 is a side elevation view of a vessel being buoyed by spin floats.

Referring to the drawings, and more particularly to FIG. 1, it can be seen that the flotation for the vessel 1 being described comprises a plurality of circular spin floats 2 shaped generally as a disk. Each disk or "spin float" is suitably affixed to the underside of the vessel in such a manner as to allow the spin float 2 to be rotated at a high rate of speed. The upper side 3 of the spin float 1 is generally flat.

Figure 2:
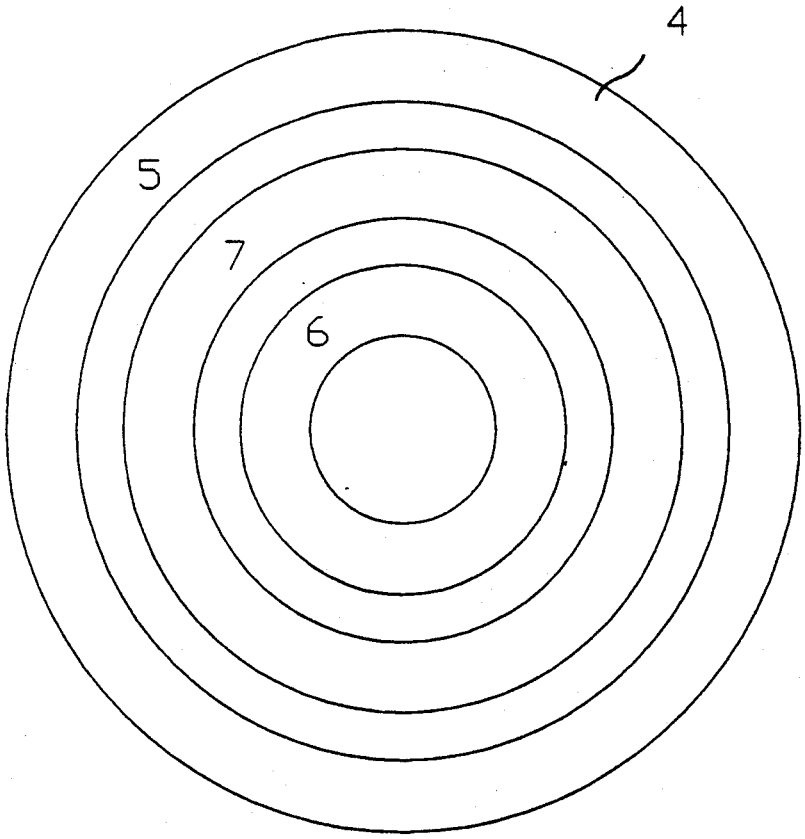
FIG. 2 is a bottom view of a spin float.

Referring to FIG. 2 it can be seen that the under side 4 of the spin float is formed into three concentric donut like rings or "pods" 5, 6, and 7.

Figure 3:
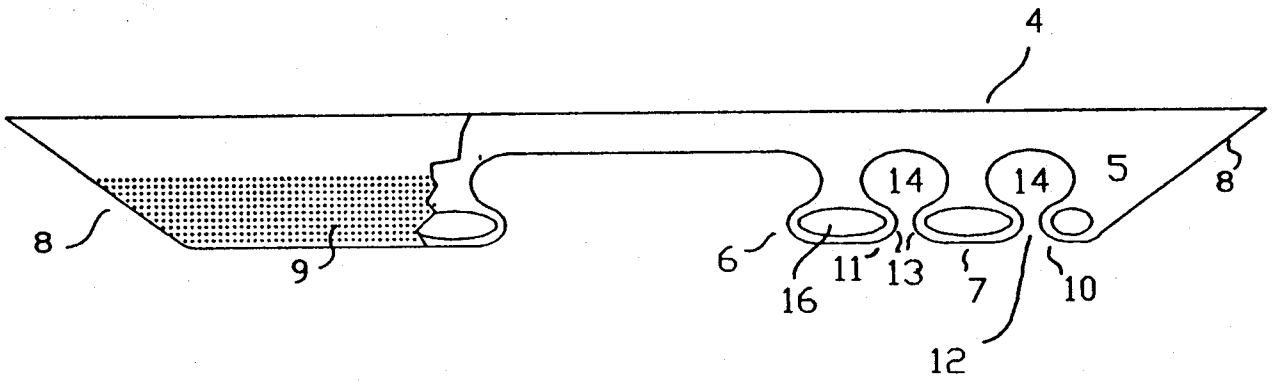
FIG. 3 is a cut away side elevation view of a spin float.

Referring to FIG. 3 it can be seen that the outer side 8 of the outer pod 5 has a generally flat surface and is formed at an angel of 37 degrees from the upper side 4, this particular angle being the most efficient for both creating lift and movement across the water. The outer side 8 of the outer pod 5 is covered with golf ball like dimples 9. These dimples create a compressed air field as the spin float is rotated, creating lift for the vessel. The inner side 10 of the outer pod 5, the outer side 11 of the inner pod 6, and both sides of the mid pod 7 are swollen into curved pertrusions 13 so that there is a circular cavity 14 formed between the pods. The cavity is open at the bottom due to the fact that the swells or curved protrusions 13 do not touch. The circular openings 12 at the bottom of the cavitys 13 is equal to ⅓ the vertical diameters of the cavities 13. The pods are hollow, thus forming an inner cavity 16 within each pod. These inner cavities 16 may be filled with lighter than air gas in order to decrease weight and thus increase lift.

Figure 4:
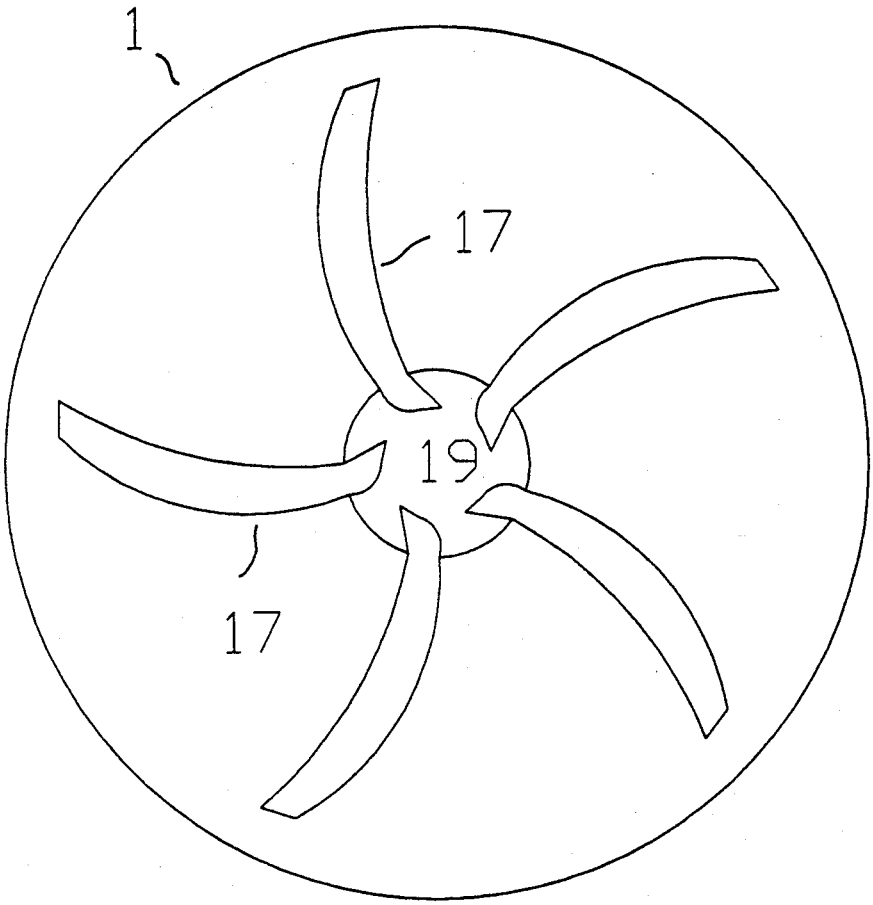
FIG. 4 is a top elevation view of a spin float showing air scoop blades.

Referring to FIG. 4 it can be seen that a plurality of air scoop blades 17 are affixed to the top side of the spin float 1. It can also be seen that a circular opening 19 is present at the center of the spin float 1. This opening is somewhat smaller in diameter than the inner pod (not shown). The air scoop blades 17 are curved downward at the center of the spin float, into the circular opening 19 so as to force air into the cavity within the inner pod, thus producing pressure against the surface of the water in order to produce lift.

Figure 5:
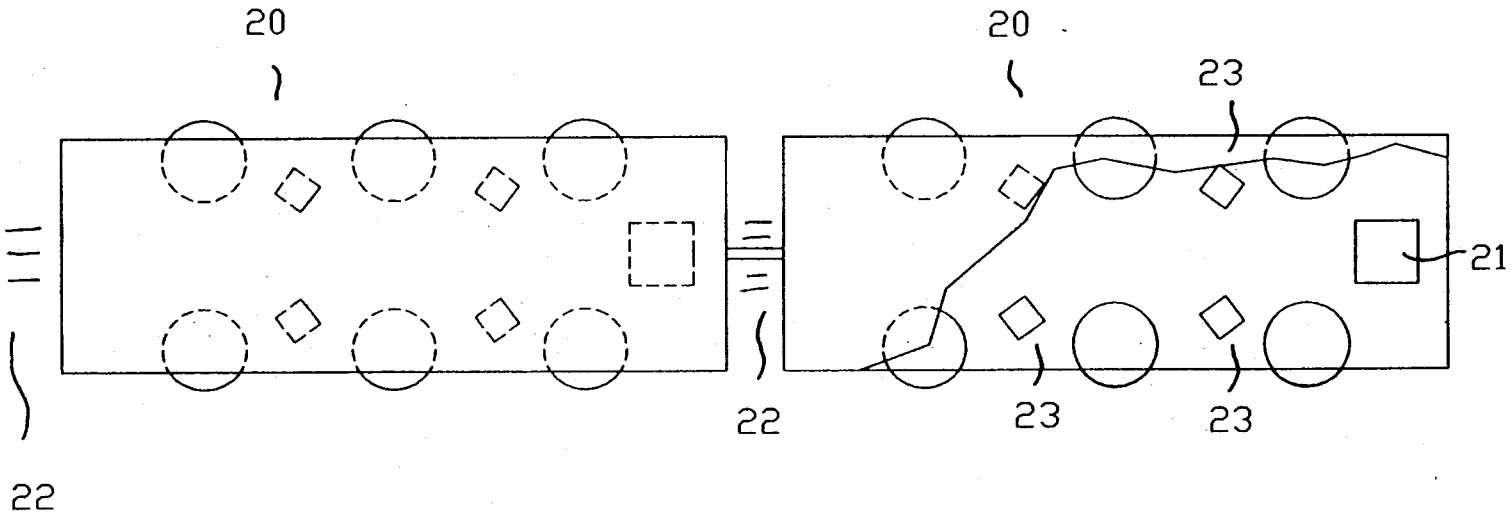
FIG. 5 is a top elevation view of two linked units showing the location of the jet pumps, the jet stream, and the centrifugal pumps.

Referring to FIG. 5, it can be seen that each unit 20 in a series of linked units is equipped with a jet pump 21 at the forward end of the unit. Each of these jet pumps 21 takes in a high volume of air and water, and discharges it to the rear, generating forward thrust and creating a jet stream of water 22 moving to the rear of the series of linked units. Each successive jet pump 21 gains power from and adds to the jet stream 22. It can also be seen that the vessel is equipped with a plurality of centrifugal pumps 23. These centrifugal pumps take in a high volume of water and discharge it inward and rearward at an angle of thirty seven degrees with respect to the direction of the jet stream 22, thirty seven degrees being the angle of maximum efficiency. These centrifugal pumps 23 are pivotally affixed to the vessel so as to be pivoted in order to provide slow speed docking maneuverability.

Figure 6:
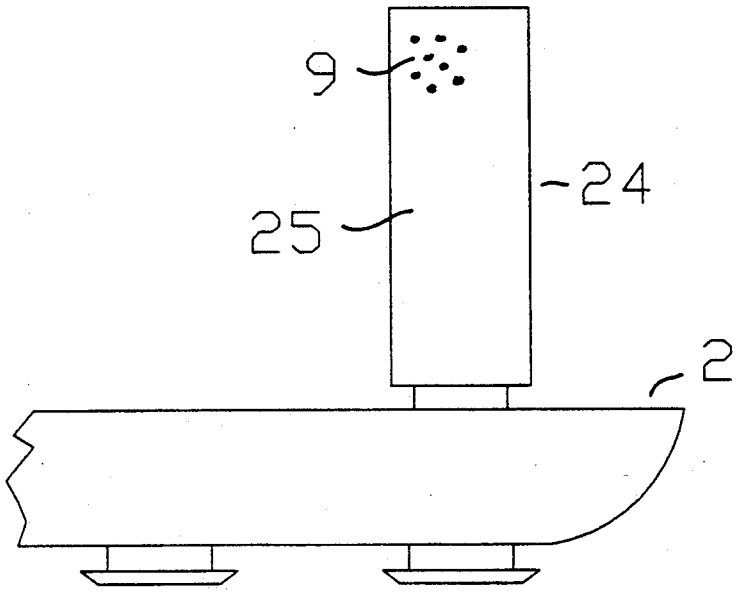
FIG. 6 is a side elevation view of a vector sail.

Referring to FIG. 6, it can be seen that the vessel is equipped with an especially designed vector sail 24. It can also be seen that the vector sail is affixed to the deck 2 of the vessel in a vertical position so that the vector sail 24 may be spun at high speed. The outer surface 25 of the vector sail is covered with a plurality of golf ball like dimples 9. As the sail is rotated, the dimples form a field of compressed air around the vector sail 24, providing thrust.

Figure 7:
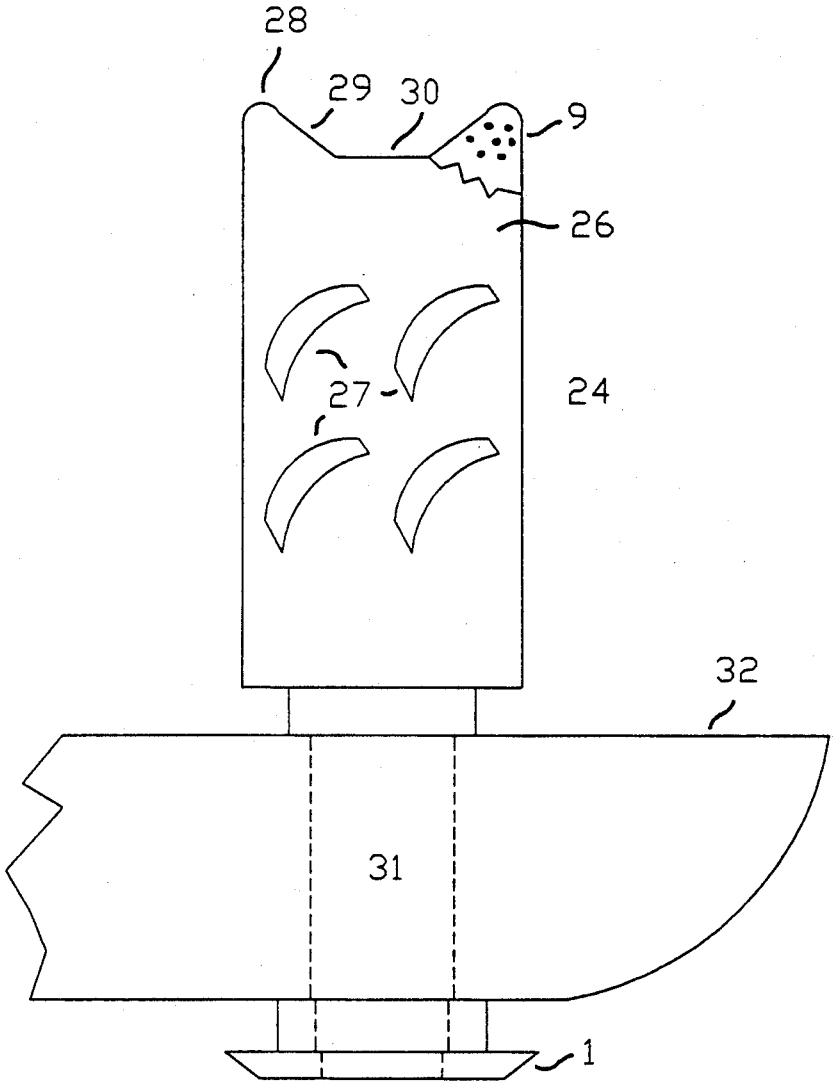
FIG. 7 is a cut away side elevation view of a vector sail, located over a spin float.

Referring to FIG. 7, it can be seen that the inner surface 26 of the vector sail is covered by a plurality of dimples 9. It can also be seen that a set of air suction blades 27 are affixed to the inner surface 26 of the vector sail cylinder wall. The surfaces of the air suction blades 27 are also equipped with dimples. The dimples 9 create a compressed air field and therefore reduce friction between the surfaces and moving air. The upper rim 28 of the vector sail 24 is rounded inward, and graduates into a relatively flat inner curved surface 29 that is tilted at 37 degrees from vertical. The inner curved surface 29 is covered with dimples and encircles a center rim opening 30 which has a diameter ⅓ that of the vector sail 24. The ⅓ diameter opening and the 37 degree tilt is the most efficient for air flow. As the vector sail 24 is rotated, air is sucked into the interior of the vector sail 24 by the air suction blades 27 producing a downward moving column of air. The vector sail 24 is positioned over a hole 31 in the deck 32. This opening may be positioned over the jet pump. In such a case the downward column of air is forced toward the intake of the jet pump in a "ram air" situation, thus increasing the efficiency and power of the jet pump. In this cases, the hole 31 in the deck 32 is positioned directly over a spin float 1. This would force the downward column of air through the hole 31 in the deck 32, and the opening 33 in the top of the spin float 1, producing increased air pressure within the inner pod of the spin float, thus producing increased lift.

Figure 8:
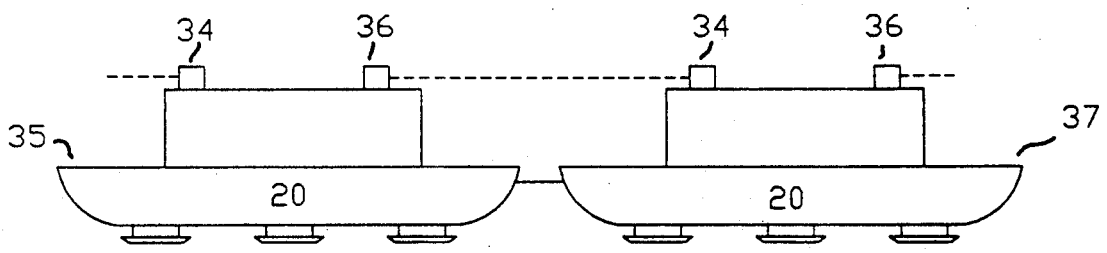
FIG. 8 is a side elevation view of two linked units equipped with the laser alignment system.

Referring to FIG. 8, it can be seen that the units 20 may be linked in a train like manner. Each unit 20 is equipped with a laser emitter 34 at its stern 35, and an array of laser detectors 36 at its bow 37. The laser emitter 34 emits a laser beam directly astern. If each unit is properly aligned the laser beam will strike the array of laser detectors 36 affixed to the following unit 20.

Figure 9:
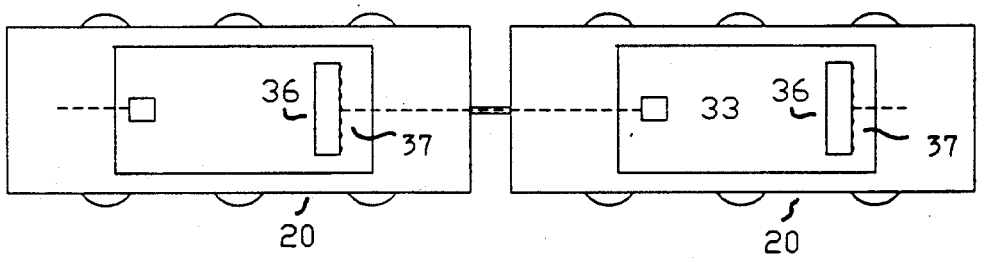
FIG. 9 is a top elevation view of two linked units equipped with the laser alignment system.

Referring to FIG. 9, it can be seen that the array of laser detectors 36 consists of a row of laser detecting cells 37 aligned in a vertical configuration perpendicular to the desired line of the linked units 20. As a unit 20 becomes misalignment with the preceding unit 33, the laser beam is swept in the opposite direction of the misalignment, across the row of laser detecting cells 37. By determining the cell that is being struck by the beam the control unit (not shown) can determine the direction and degree of miss-alignment.

Figure 10:
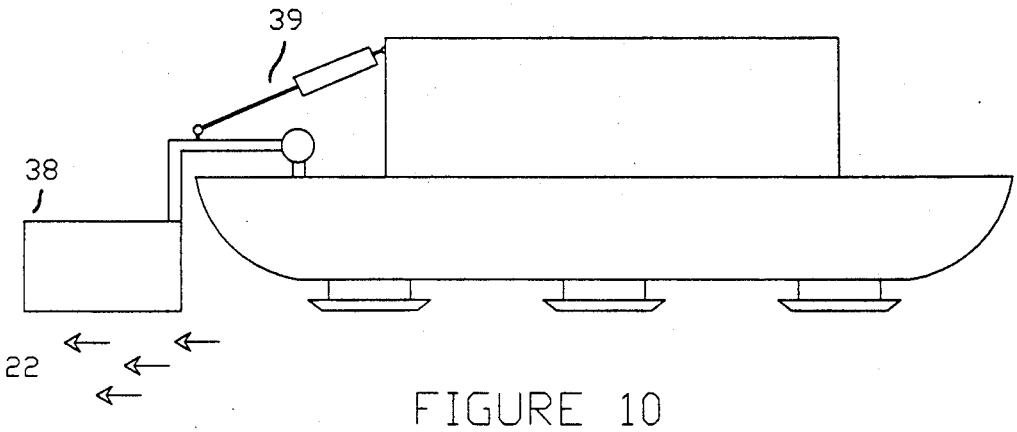
FIG. 10 is a side elevation view of the water plow rudder mounted to a vessel unit.
Figure 11:
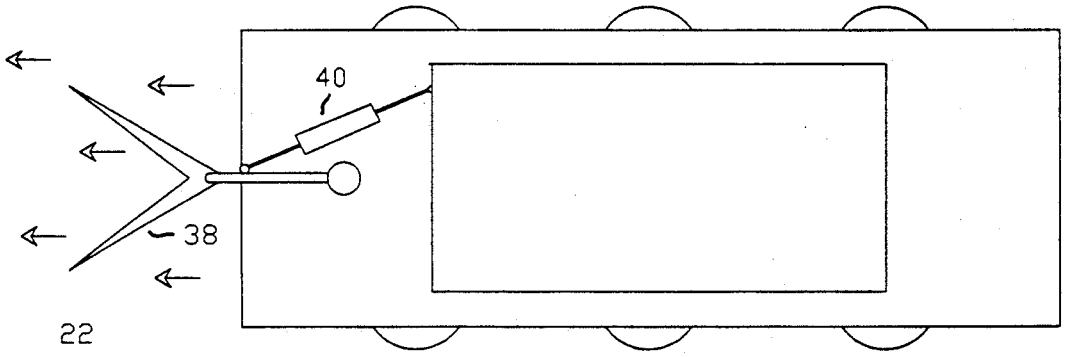
FIG. 11 is a top elevation view of the water plow rudder mounted to a vessel unit.

Referring to FIGS. 10 and 11, it can be seen that a combination break - alignment mechanism shaped basically as a plow is affixed to the rear of each unit. The water plow rudder consists of the rudder blade 38 itself, a lowering hydraulic arm 39 that, upon direction from the control unit (not shown), forces the rudder blade 38 into the jet stream 22, and a tilt setting hydraulic arm 40 which sets the tilt of the rudder blade 38 in accordance with the control unit (not shown). The rudder blade 38 may be forced into the jet stream at a level position to be used merely as a deceleration device, or may be set at an angle in order to realign the units in accordance with the control unit (not shown) as directed by the laser alignment system.

I claim:

1. a vessel for over water transportation and transporting of cargo suitable for use as a single unit, or as a series of linked units comprising a means for flotation of said vessel, a means for propelling said vessel, said means further comprising a jet stream of water beneath said vessel, a means for maintaining alignment of said series of linked units, and a means for decelerating said vessel, wherein said means for flotation of said vessel comprises a plurality of horizontal, pivotally mounted spin floats suitably affixed to each of said unit, said spin floats further comprising a circular, disk shaped base having an upper and under side, and a center, a plurality of do-nut shaped concentric downward pods formed on said under side of said base, said pods further comprising an inner pod, an outer pod, and a plurality of mid pods, said mid pods being located equidistantly between said outer pod and said inner pod, all said pods encircling said center of said base, each said pod having an inner and outer side, said outer side of said outer pod being formed angularly at a downward angle from said base of 37 degrees, said outer side of said outer pod having a generally flat surface, said surface further comprising a plurality of dimples, said dimples suitably formed into said flat surface so as to create a field of compressed air adjacent to said flat surface, thus creating vertical lift.

2. a vessel as recited in claim 1, wherein said inner side of said outer pod, said outer side of said inner pod, and said outer and inner sides of said mid pods are formed in a generally curved shape, having a mid curve area, said sides further comprise a curved protrusion formed at said mid point area of said curved sides, each said curved protrusion being suitably formed so as to create circular, concentric cavities between each adjacent said pod, each said cavity further comprising a top side, bottom side, and a mid section, each said cavity further comprising a circular opening at said bottom of said cavity.

3. a vessel as recited in claim 2, wherein said circular opening comprises a specific width, said specific width being equal to one third the width of said concentric cavity at said mid section.

4. a vessel as recited in claim 3, wherein said pods further comprise an inner cavity, said inner cavity being filled with a lighter than air gas.

5. a vessel as recited in claim 3, wherein said spin floats are constructed of a suitable material, said suitable material being woven so as to provide maximum strength.

6. a vessel as recited in claim 3, wherein said means for propelling said vessel comprises a vector sail, said vector sail further comprising a cylindrical shaped structure having a cylinder wall with an inner surface and an outer surface, said structure being pivotally mounted to said vessel in a vertical position, said structure being spun at high speed, said outer surface of said structure further comprising a plurality of dimples, said dimples suitably formed into said outer surface as to create a compressed air field adjacent to said outer surface as said structure is spun, said compressed air field creating forward thrust as said structure is moved forward.

7. a vessel as recited in claim 6, wherein said inner surface further comprises a plurality of dimples, said vector sail further comprising a plurality of air suction blades, said air suction blades so affixed to said inner surface as to produce a downward column of air within said vector sail as said vector sail is rotated, said air suction blades having blade surfaces, said blade surfaces further comprising a plurality of dimples, said cylinder shaped structure further comprises an upper rim, said upper rim being curved inward with a rounded top, and a substantially flat inner curve surface, said flat inner curve surface lying at 37 degrees tilt from vertical, said flat inner curve surface further comprising a plurality of dimples, said inner curve surface encircling a center rim opening, said center rim opening having a diameter one third that of said upper rim.

8. a vessel as recited in claim 7, wherein said vessel further comprises a deck, said deck further comprising a hole, said hole being located directly beneath said vector sail so as to direct said column of air through said hole, said jet pump further comprising a jet motor air intake, said hole being situated directly above said jet motor air intake, so as to assist said air intake of said jet motor.

9. a vessel as described in claim 7, wherein said spin floats further comprise a plurality of curved air scoop blades, each said air scoop blade having an upper and lower edge, said lower edge of each said air scoop blade being affixed to said upper side of said base of said spin float, said air scoop blades being arranged equidistant around said upper side of said base of said spin float so as to direct air toward said center of said spin float as said spin float is rotated, said base of said spin float further comprising a circular opening at said center, said circular opening being smaller in diameter than said inner pod, each said air scoop blade further comprising an outward and an inward end, said inward end being curved downward into said circular opening at said center of said base of said spin float, so as to direct a current of air downward through said circular opening in said base of said spin float, thus building air pressure within said inner pod, thus creating lift.

10. a vessel as recited in claim 9, wherein said air scoop blades further comprise a front and back side, said sides having a plurality of dimples, so as to create a compressed air field at said sides, thus reducing friction.

11. a vessel as recited in claim 10, wherein said hole in said deck is located directly above said circular opening in said base of said spin float, so as to direct said column of air within said vector sail downward into said circular opening in said spin float so as to further produce pressure within said inner pod.

12. a vessel as recited in claim 1, wherein said means of propelling said vessel further comprises a plurality of centrifugal pumps, said centrifugal pumps so arranged as to take in a high volume of water from without a jet stream of water, and direct said high volume of water rearward and toward said jet stream of water at an angle of 37 degrees to said jet stream of water.

13. a vessel as recited in claim 12, wherein said centrifugal pumps are hydraulically driven.

14. a vessel as recited in claim 12, wherein said centrifugal pumps are pivotally mounted to said vessel so as to allow for use in slow speed steering.

15. a vessel as recited in claim 1, said vessel further comprising a series of said linked units, wherein said linked units further comprise a forward and a rearward unit, and wherein said means for aligning said linked units comprises a laser emitter, and an array of laser detectors, said laser emitter suitably attached to said forward unit so as to direct said laser directly rearward toward said rearward unit, said laser detectors being suitably attached to said rearward unit so as to receive said laser, said laser detectors being aligned vertically in a plane perpendicular to said series of said linked units, so as to allow said array of laser detectors to detect the existence, direction and degree of misalignment of said linked units.

16. a vessel as recited in claim 15, wherein said means of aligning said linked units further comprises an inverted plow rudder, said rudder further comprising a rudder blade, a tilting hydraulic arm, and a lowering hydraulic arm, said rudder blade being suitably mounted so as to allow said rudder blade to have a specific tilt, said tilt being set by said tilting hydraulic arm, at the direction of said laser detectors.

17. a vessel as recited in claim 16, wherein said rudder blade is suitably mounted so as to allow said rudder blade to be lowered into a jet stream of water by said lowering hydraulic arm at the direction of said laser detector.

18. a vessel as recited in claim 17, wherein said means for decelerating said vessel comprises the lowering of said inverted plow rudder into said jet stream of water.

* * * * *